US008025162B2

(12) United States Patent
Hardy

(10) Patent No.: US 8,025,162 B2
(45) Date of Patent: Sep. 27, 2011

(54) PRODUCT MANAGEMENT DISPLAY SYSTEM

(75) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 12/835,843

(22) Filed: Jul. 14, 2010

(65) Prior Publication Data

US 2010/0276383 A1 Nov. 4, 2010

Related U.S. Application Data

(60) Division of application No. 12/633,417, filed on Dec. 8, 2009, now Pat. No. 7,922,010, and a continuation of application No. 11/409,784, filed on Apr. 24, 2006, now Pat. No. 7,628,282, and a continuation-in-part of application No. 11/257,718, filed on Oct. 25, 2005, now Pat. No. 7,497,342.

(51) Int. Cl.
*A47F 1/04* (2006.01)

(52) U.S. Cl. ..... 211/59.3; 211/151

(58) Field of Classification Search ..... 211/59.3, 211/151, 162, 184, 59.2, 51; 193/35 R, 37, 193/37 B; 221/226, 227, 270; 414/276, 414/331.08, 331.16; 312/61, 71, 97, 91
See application file for complete search history.

(56) References Cited

U.S. PATENT DOCUMENTS

| | | | |
|---|---|---|---|
| 154,940 | A | 9/1874 | Adams |
| 355,511 | A | 1/1887 | Danner |
| 632,231 | A | 9/1899 | Blades |
| 808,067 | A | 12/1905 | Briggs |
| 847,863 | A | 3/1907 | Watts |
| 1,156,140 | A | 10/1915 | Hair |
| 1,703,987 | A | 3/1929 | Butler |
| 1,712,080 | A | 5/1929 | Kelly |
| 1,714,266 | A | 5/1929 | Johnson |
| 1,734,031 | A | 11/1929 | Carlson |
| 1,786,392 | A | 12/1930 | Kemp |
| 1,964,597 | A | 6/1934 | Rapellin |
| 1,971,749 | A | 8/1934 | Hamilton |
| 1,991,102 | A | 2/1935 | Kernaghan |

(Continued)

FOREIGN PATENT DOCUMENTS

| | | |
|---|---|---|
| BE | 906083 | 4/1987 |

(Continued)

OTHER PUBLICATIONS

*RTC Industries, Inc.*, v. *Henschel-Steinau, Inc.*, Complaint, Case: 1:10-cv-07460 Document #:1 Filed Nov. 19, 2010.

(Continued)

*Primary Examiner* — Jennifer E. Novosad
(74) *Attorney, Agent, or Firm* — Banner & Witcoff, Ltd.

(57) ABSTRACT

A product management display system for merchandising both larger and heavier products includes using a pusher mechanism along with one or more roller assemblies that, in combination, improve the merchandising of products on the shelves, especially on horizontal or non-inclined shelves or surfaces. In an exemplary embodiment, the product management display system includes a pusher mechanism configured to urge product forward and toward the front of the shelf. At least one roller assembly is positioned beneath the product to be merchandised to assist the pusher mechanism in urging the product toward the front of the shelf.

4 Claims, 9 Drawing Sheets

U.S. PATENT DOCUMENTS

| | | | |
|---|---|---|---|
| 2,057,627 | A | 10/1936 | Ferris |
| 2,079,754 | A | 5/1937 | Waxgiser |
| 2,085,479 | A | 6/1937 | Shaffer et al. |
| 2,110,299 | A | 3/1938 | Hinkle |
| 2,111,496 | A | 3/1938 | Scriba |
| 2,129,122 | A | 9/1938 | Follett |
| 2,218,444 | A | 10/1940 | Vineyard |
| 2,499,088 | A | 2/1950 | Brill et al. |
| 2,516,122 | A | 7/1950 | Hughes |
| 2,555,102 | A | 5/1951 | Anderson |
| 2,563,570 | A | 8/1951 | Williams |
| 2,652,154 | A | 9/1953 | Stevens |
| 2,670,853 | A | 3/1954 | Schneider |
| 2,678,045 | A | 5/1954 | Erhard |
| 2,738,881 | A | 3/1956 | Michel |
| 2,750,049 | A | 6/1956 | Hunter |
| 2,775,365 | A | 12/1956 | Mestman et al. |
| 2,893,596 | A | 7/1959 | Gabrielsen |
| 2,918,295 | A | 12/1959 | Milner |
| 2,934,212 | A | 4/1960 | Jacobson |
| 2,948,403 | A | 8/1960 | Vallez |
| 3,083,067 | A | 3/1963 | Vos et al. |
| 3,103,396 | A | 9/1963 | Portnoy |
| 3,151,576 | A | 10/1964 | Patterson |
| 3,161,295 | A | 12/1964 | Chesley |
| 3,166,195 | A | 1/1965 | Taber |
| 3,285,429 | A | 11/1966 | Propst |
| 3,308,961 | A | 3/1967 | Chesley |
| 3,308,964 | A | 3/1967 | Pistone |
| 3,348,732 | A | 10/1967 | Schwarz |
| 3,405,716 | A | 10/1968 | Cafiero et al. |
| 3,452,899 | A | 7/1969 | Libberton |
| 3,497,081 | A | 2/1970 | Field |
| 3,501,020 | A | 3/1970 | Krikorian |
| D219,058 | S | 10/1970 | Kaczur |
| 3,550,979 | A | 12/1970 | Protzmann |
| 3,598,246 | A | 8/1971 | Galli |
| 3,652,154 | A | 3/1972 | Gebel |
| 3,667,826 | A | 6/1972 | Wood et al. |
| 3,698,568 | A | 10/1972 | Armstrong |
| 3,709,371 | A | 1/1973 | Luck |
| 3,751,129 | A | 8/1973 | Wright et al. |
| 3,814,490 | A | 6/1974 | Dean et al. |
| 3,815,519 | A | 6/1974 | Meyer |
| 3,830,169 | A | 8/1974 | Madey |
| 3,848,745 | A | 11/1974 | Smith |
| 3,868,021 | A | 2/1975 | Heinrich |
| 3,870,156 | A | 3/1975 | O'Neill |
| 4,007,841 | A | 2/1977 | Seipel |
| 4,042,096 | A | 8/1977 | Smith |
| 4,106,668 | A | 8/1978 | Gebhardt et al. |
| 4,269,326 | A | 5/1981 | Delbrouck |
| 4,300,693 | A | 11/1981 | Spamer |
| 4,303,162 | A | 12/1981 | Suttles |
| 4,314,700 | A | 2/1982 | Dylag |
| 4,331,243 | A | 5/1982 | Doll |
| 4,351,439 | A | 9/1982 | Taylor |
| 4,378,872 | A | 4/1983 | Brown |
| 4,448,653 | A | 5/1984 | Wegmann |
| 4,454,948 | A | 6/1984 | Spamer |
| 4,460,096 | A | 7/1984 | Ricci |
| 4,463,854 | A | 8/1984 | MacKenzie |
| 4,467,927 | A | 8/1984 | Nathan |
| 4,482,066 | A | 11/1984 | Dykstra |
| 4,488,653 | A | 12/1984 | Belokin |
| 4,504,100 | A | 3/1985 | Chaumard |
| 4,588,093 | A | 5/1986 | Field |
| 4,589,349 | A | 5/1986 | Gebhardt et al. |
| 4,602,560 | A | 7/1986 | Jacky |
| 4,615,276 | A | 10/1986 | Garabedian |
| 4,620,489 | A | 11/1986 | Albano |
| 4,629,072 | A | 12/1986 | Loew |
| 4,651,883 | A | 3/1987 | Gullett et al. |
| 4,685,574 | A | 8/1987 | Young et al. |
| 4,705,175 | A | 11/1987 | Howard et al. |
| 4,706,821 | A | 11/1987 | Kohls et al. |
| 4,724,968 | A | 2/1988 | Wombacher |
| 4,729,481 | A | 3/1988 | Hawkinson et al. |
| 4,730,741 | A | 3/1988 | Jackle, III et al. |
| 4,742,936 | A | 5/1988 | Rein |
| 4,762,235 | A | 8/1988 | Howard et al. |
| 4,762,236 | A | 8/1988 | Jackle, III et al. |
| 4,775,058 | A | 10/1988 | Yatsko |
| 4,776,472 | A | 10/1988 | Rosen |
| 4,790,037 | A | 12/1988 | Phillips |
| 4,809,856 | A | 3/1989 | Muth |
| 4,828,144 | A | 5/1989 | Garrick |
| 4,830,201 | A | 5/1989 | Breslow |
| 4,836,390 | A | 6/1989 | Polvere |
| 4,846,367 | A | 7/1989 | Guigan et al. |
| 4,883,169 | A | 11/1989 | Flanagan, Jr. |
| 4,899,668 | A | 2/1990 | Valiulis |
| 4,901,853 | A | 2/1990 | Maryatt |
| 4,901,869 | A | 2/1990 | Hawkinson et al. |
| 4,907,707 | A | 3/1990 | Crum |
| 4,934,645 | A | 6/1990 | Breslow |
| 5,012,936 | A | 5/1991 | Crum |
| 5,025,936 | A | 6/1991 | Lamoureaux |
| 5,027,957 | A | 7/1991 | Skalski |
| 5,082,125 | A | 1/1992 | Ninni |
| 5,088,607 | A | 2/1992 | Risafi et al. |
| 5,110,192 | A | 5/1992 | Lauterbach |
| 5,111,942 | A | 5/1992 | Bemardin |
| 5,123,546 | A | 6/1992 | Crum |
| 5,148,927 | A | 9/1992 | Gebka |
| 5,161,702 | A | 11/1992 | Skalski |
| 5,178,258 | A | 1/1993 | Smalley |
| 5,183,166 | A | 2/1993 | Belokin, Jr. et al. |
| 5,190,186 | A | 3/1993 | Yablans et al. |
| 5,203,463 | A | 4/1993 | Gold |
| 5,215,199 | A | 6/1993 | Bejarano |
| 5,255,802 | A | 10/1993 | Krinke et al. |
| 5,265,738 | A | 11/1993 | Yablans et al. |
| 5,316,154 | A | 5/1994 | Hajec, Jr. |
| 5,341,945 | A | 8/1994 | Gibson |
| 5,351,839 | A | 10/1994 | Beeler et al. |
| 5,366,099 | A | 11/1994 | Schmid |
| 5,381,908 | A | 1/1995 | Hepp |
| 5,390,802 | A | 2/1995 | Pappagallo et al. |
| 5,413,229 | A | 5/1995 | Zuberbuhler et al. |
| 5,415,297 | A | 5/1995 | Klein et al. |
| 5,450,969 | A | 9/1995 | Johnson et al. |
| 5,458,248 | A | 10/1995 | Alain |
| 5,464,105 | A | 11/1995 | Mandeltort |
| 5,469,975 | A | 11/1995 | Fajnsztajn |
| 5,469,976 | A | 11/1995 | Burchell |
| 5,542,552 | A | 8/1996 | Yablans et al. |
| 5,562,217 | A | 10/1996 | Salveson et al. |
| 5,613,621 | A | 3/1997 | Gervasi |
| D378,888 | S | 4/1997 | Bertilsson |
| 5,615,780 | A | 4/1997 | Nimetz et al. |
| 5,634,564 | A | 6/1997 | Spamer et al. |
| 5,638,963 | A | 6/1997 | Finnelly et al. |
| 5,665,304 | A | 9/1997 | Heinen et al. |
| 5,673,801 | A | 10/1997 | Markson |
| D386,363 | S | 11/1997 | Dardashti |
| 5,685,664 | A | 11/1997 | Parham et al. |
| 5,730,320 | A | 3/1998 | David |
| 5,738,019 | A | 4/1998 | Parker |
| 5,740,944 | A | 4/1998 | Crawford |
| 5,743,428 | A | 4/1998 | Rankin, VI |
| 5,746,328 | A | 5/1998 | Beeler et al. |
| 5,788,090 | A | 8/1998 | Kajiwara |
| 5,803,276 | A | 9/1998 | Vogler |
| 5,826,731 | A | 10/1998 | Dardashti |
| 5,839,588 | A | 11/1998 | Hawkinson |
| 5,855,283 | A | 1/1999 | Johnson |
| 5,873,473 | A | 2/1999 | Pater |
| 5,878,895 | A | 3/1999 | Springs |
| 5,906,283 | A | 5/1999 | Kump et al. |
| 5,971,204 | A | 10/1999 | Apps |
| 6,006,678 | A | 12/1999 | Merit |
| 6,041,720 | A | 3/2000 | Hardy |
| 6,082,557 | A | 7/2000 | Leahy |
| 6,112,938 | A | 9/2000 | Apps |
| 6,129,218 | A | 10/2000 | Henry et al. |
| 6,142,317 | A | 11/2000 | Merl |

| | | | | |
|---|---|---|---|---|
| 6,164,491 | A | 12/2000 | Bustos et al. | |
| 6,173,845 | B1 | 1/2001 | Higgins et al. | |
| 6,209,733 | B1 | 4/2001 | Higgins et al. | |
| 6,227,385 | B1 | 5/2001 | Nickerson | |
| 6,234,325 | B1 | 5/2001 | Higgins et al. | |
| 6,234,326 | B1 | 5/2001 | Higgins et al. | |
| 6,234,328 | B1 | 5/2001 | Mason | |
| D445,615 | S | 7/2001 | Burke | |
| 6,253,954 | B1 | 7/2001 | Yasaka | |
| 6,357,606 | B1 | 3/2002 | Henry | |
| 6,382,431 | B1 | 5/2002 | Burke | |
| 6,389,991 | B1 | 5/2002 | Morrisson | |
| 6,401,942 | B1 | 6/2002 | Eckert | |
| 6,405,880 | B1 | 6/2002 | Webb | |
| 6,409,027 | B1 | 6/2002 | Chang et al. | |
| 6,409,028 | B2 | 6/2002 | Nickerson | |
| 6,464,089 | B1 | 10/2002 | Rankin, VI | |
| 6,484,891 | B2 | 11/2002 | Burke | |
| 6,497,326 | B1 | 12/2002 | Osawa | |
| 6,523,703 | B1 | 2/2003 | Robertson | |
| 6,527,127 | B2 | 3/2003 | Dumontet | |
| 6,533,131 | B2 | 3/2003 | Bada | |
| D472,411 | S | 4/2003 | Burke | |
| 6,622,874 | B1 | 9/2003 | Hawkinson | |
| 6,655,536 | B2 | 12/2003 | Jo et al. | |
| 6,666,533 | B1 | 12/2003 | Stavros | |
| D485,699 | S | 1/2004 | Mueller et al. | |
| 6,772,888 | B2 | 8/2004 | Burke | |
| 6,866,156 | B2 | 3/2005 | Nagel et al. | |
| 6,886,699 | B2 | 5/2005 | Johnson et al. | |
| 6,889,854 | B2 | 5/2005 | Burke | |
| 6,948,900 | B1 | 9/2005 | Neuman | |
| 6,964,235 | B2 | 11/2005 | Hardy | |
| 7,093,546 | B2 | 8/2006 | Hardy | |
| 7,216,770 | B2 | 5/2007 | Mueller | |
| 7,395,938 | B2 | 7/2008 | Merit et al. | |
| 7,458,473 | B1 | 12/2008 | Mason | |
| 7,497,342 | B2 * | 3/2009 | Hardy | 211/59.3 |
| 7,628,282 | B2 * | 12/2009 | Hardy | 211/59.3 |
| 7,641,057 | B2 | 1/2010 | Mueller et al. | |
| 7,922,010 | B2 * | 4/2011 | Hardy | 211/59.3 |
| 2001/0010302 | A1 | 8/2001 | Nickerson | |
| 2002/0036178 | A1 | 3/2002 | Tombu | |
| 2002/0108916 | A1 | 8/2002 | Nickerson | |
| 2002/0148794 | A1 | 10/2002 | Marihugh | |
| 2002/0170866 | A1 | 11/2002 | Johnson et al. | |
| 2003/0000956 | A1 | 1/2003 | Maldonado | |
| 2003/0010732 | A1 | 1/2003 | Burke | |
| 2003/0057167 | A1 | 3/2003 | Johnson et al. | |
| 2003/0061973 | A1 | 4/2003 | Bustos | |
| 2003/0085187 | A1 | 5/2003 | Johnson et al. | |
| 2003/0141265 | A1 | 7/2003 | Jo et al. | |
| 2003/0217980 | A1 | 11/2003 | Johnson et al. | |
| 2004/0104239 | A1 | 6/2004 | Black, Jr. et al. | |
| 2004/0140278 | A1 | 7/2004 | Johnson et al. | |
| 2004/0140279 | A1 | 7/2004 | Johnson et al. | |
| 2004/0245197 | A1 | 12/2004 | McElvaney | |
| 2006/0049122 | A1 | 3/2006 | Johnson et al. | |
| 2006/0163272 | A1 | 7/2006 | Gamble | |
| 2006/0186064 | A1 | 8/2006 | Merit et al. | |
| 2006/0237381 | A1 | 10/2006 | Lockwood et al. | |

FOREIGN PATENT DOCUMENTS

| | | | |
|---|---|---|---|
| CH | 412 251 | | 4/1966 |
| DE | 969003 | | 4/1958 |
| DE | 1819158 | | 7/1960 |
| DE | 2002720 | | 7/1971 |
| DE | 2232398 | | 1/1974 |
| DE | 2825724 | A1 | 12/1979 |
| DE | 8308485 | | 9/1983 |
| DE | 8426651 | | 7/1985 |
| DE | 29902688 | | 7/1999 |
| DE | 7311113 | | 2/2009 |
| EP | 0004921 | | 4/1979 |
| EP | 0018003 | | 7/1984 |
| EP | 0224107 | A2 | 11/1986 |
| EP | 270016 | | 6/1988 |
| EP | 0337340 | | 10/1989 |
| EP | 0408400 | A1 | 7/1990 |
| EP | 0398500 | A1 | 11/1990 |
| EP | 0454586 | B1 | 10/1991 |
| EP | 0587059 | | 3/1994 |
| EP | 986980 | | 3/2000 |
| EP | 0779047 | B1 | 4/2000 |
| EP | 1395152 | | 2/2005 |
| EP | 0176209 | | 4/2008 |
| FR | 2385365 | | 10/1978 |
| FR | 2526338 | | 11/1983 |
| FR | 2617385 | | 1/1989 |
| GB | 697994 | | 10/1953 |
| GB | 740311 | | 11/1955 |
| GB | 881700 | | 11/1961 |
| GB | 1082150 | | 9/1967 |
| GB | 2027339 | A | 2/1980 |
| GB | DES.2037553 | | 7/1994 |
| GB | 2281289 | | 1/1995 |
| GB | 2283407 | A | 5/1995 |
| GB | 2290077 | | 12/1995 |
| GB | 2297241 | A | 7/1996 |
| GB | 2392667 | A | 3/2004 |
| GB | 1088654 | | 4/2008 |
| JP | 54168195 | | 11/1979 |
| JP | 59218113 | | 8/1984 |
| JP | 62060521 | A | 3/1987 |
| JP | 6329463 | | 2/1988 |
| JP | 02-191413 | | 7/1990 |
| JP | 6202945 | | 7/1994 |
| JP | 11342054 | | 12/1999 |
| JP | 2000157378 | | 6/2000 |
| JP | 2000350642 | | 12/2000 |
| JP | 2001104117 | | 4/2001 |
| JP | 2003210286 | | 7/2003 |
| NL | 106617 | | 11/1963 |
| NL | 8520125 | | 1/1986 |
| SE | 394537 | | 6/1977 |
| SU | 1600615 | | 10/1990 |
| WO | 9115141 | A | 10/1991 |
| WO | 0071004 | | 11/2000 |
| WO | 02091885 | | 11/2002 |
| WO | 03032775 | | 4/2003 |

OTHER PUBLICATIONS

FFr Yello Pages® 2003 Product Catalog, "Merchandising Ideas Made Easy for Every Retail Environment!", Cover p. 9-11, 48-49,52-58, Back Cover.

*RTC Industries, Inc.*, v. *Fasteners for Retail, Inc., and SuperValu, Inc. d/b/a Cub Foods*, Complaint, Document 1, Case No. 05C 6940 filed Dec. 8, 2005.

*RTC Industries, Inc.*, v. *Fasteners for Retail, Inc., and SuperValu, Inc. d/b/a Cub Foods*, Stipulation of Dismissal, Civil Action No. 05 C 6940, Apr. 2006.

*RTC* vs. *Fasteners for Retail*, Case No. 05C 6940, Document No. 26, filed Apr. 25, 2006.

*RTC Industries, Inc.*, v. *Fasteners for Retail, Inc., and SuperValu, Inc. d/b/a Cub Foods*, Answer of Defendant Fasteners for Retail, Inc., Civil Action No. O5 C 6940, Document 20, filed Jan. 18, 2006.

*RTC Industries, Inc.*, v. *HMG Worldwide Corporation*, Complaint, Civil Action No. 00C 3300, dated May 31, 2000.

*RTC Industries, Inc.* v. *HMG Worldwide Corporation*, Amended Complaint, dated Jan. 19, 2001.

*RTC Industries, Inc.* v. *HMG Worldwide Corporation*, RTC's Reply to HMG Worldwide Corporation's Amended Counterclaims, Civil Action No. 00 CV 3300, dated Mar. 7, 2001.

*RTC Industries, Inc.* v. *William Merit & Associates, Inc.*, Memorandum Opinion, Civil Action No. 04 C 1254, dated Jul. 15, 2004.

*RTC Industries, Inc.* v. *HMG Worldwide Corporation*, Notice of Motion, Civil Action No. 00 Civ. 3300 (JHL), dated Feb. 22, 2001.

*RTC Industries, Inc.* v. *William Merit & Associates, Inc.*, Evidentiary Objections to RTC Industries, Inc.'s Memorandum In Opposition to William Merit & Associates' Motion for Partial Summary Judgment, Civil Action No. 04 C 1254, dated Jul. 2, 2004.

*RTC Industries, Inc.*, v. *William Merit & Associates, Inc.*, William Merit & Associates' Reply to RTC Industries, Inc.'s Response to William Merit & Associates' Statement under Local Rule 56.1 of Material Facts to Which There is No Genuine Issue and Statement of Additional Facts that Require the Denial of Summary Judgment, Civil Action No. 04 C 1254, dated Jul. 2, 2004.
*RTC Industries, Inc.* v. *William Merit & Associates, Inc.*, Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.
*RTC Industries, Inc.*, v. *William Merit & Associates, Inc.*, Notice of RTC Industries, Inc.'s Motion for Leave to File its Sur-Reply to William Merit's Motion for Partial Summary Judgment, Civil Action No. 04 C 1254, dated Jul. 6, 2004.
*RTC Industries, Inc.*, v. *William Merit & Associates, Inc.*, RTC Industries, Inc.'s Sur-Reply to William Merit's Motion for Partial Summary Judgment, Civil Action No. 04 C 1254, dated Jul. 6, 2004.
*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.
*RTC Industries, Inc.* v. *Fasteners for Retail Inc.*, Plaintiff RTC Industries Inc.'s Complaint, Civil Action No. 03C 3137, dated May 12, 2003.
*RTC Industries, Inc.*, v. *Fasteners for Retail Inc., and CVS Corporation*, Amended Complaint, Civil Action No. 03C 3137, dated Aug. 6, 2003.
*RTC Industries, Inc.* v. *Semasys, Inc., and Uni-Sun, Inc.*, Complaint, Civil Action No. 04C 4081, dated Jun. 17, 2004.
*RTC Industries, Inc.* v. *Display Specialties, Inc.*, Complaint, Civil Action No. 04C 3370, dated May 12, 2004.
*RTC Industries, Inc.* v. *William Merit & Associates, Inc.*, Complaint, Civil Action No. 04C 1254, date Feb. 18, 2004.
*RTC Industries, Inc.*, v. *William Merit & Associates, Inc.*, Defendant's Notice of Motion for Partial Summary Judgment of Non-Infringement that Claims 1-8 of U.S. Patent No. 4,830,201 are Not Infringed, Civil Action No. 04C 1254, date Apr. 29, 2004.
*RTC Industries, Inc.*, v. *William Merit & Associates*, William Merit & Associates, Inc.'s Statement Under Local Rule 56.1 of Material Facts to Which There is no Genuine Issue, Civil Action No. 04 C 1254, dated Apr. 29, 2004.
*RTC Industries, Inc.* v. *William Merit & Associates, Inc.*, Defendant's Notice of Motion for Leave to File Memorandum in Support of Motion for Partial Summary Judgment in Excess of Page Limit, Civil Action No. 04 C 1254, dated Apr. 29, 2004.
*RTC Industries, Inc.* v. *William Merit & Associates, Inc.*, Declaration of William Merit in Support of Defendant's Motion for Partial Summary Judgment that Claims 1-8 of U.S. Patent No. 4,830,201 are Not Infringed, Civil Action No. 04 C 1254, dated Apr. 29, 2004.
*RTC Industries, Inc.* v. *William Merit & Associates, Inc.*, RTC Industries, Inc.'s Responses to Defendant William Merit & Associates, Inc.'s First Set of Requests for Admission to Plaintiff RTC Industries, Inc., Civil Action No. 04 C 1254, dated Jun. 1, 2004.
*RTC Industries, Inc.*, v. *William Merit & Associates, Inc.*, RTC Industries, Inc.'s Memorandum in Opposition to William Merit & Associates' Motion for Partial Summary Judgment, Civil Action No. 04 C 1254, dated Jun. 18, 2004.
*RTC Industries, Inc.* v. *William Merit & Associates, Inc.*, Notice of Filing of Additional Exhibit (The Chesley Patent) to RTC Industries, Inc.'s Memorandum in Opposition to William Merit & Associates' Motion for Partial Summary Judgment, Civil Action No. 04 C 1254, dated Jun. 22, 2004.
*RTC Industries, Inc.* v. *William Merit & Associates, Inc.*, William Merit & Associates Inc.'s Reply to RTC Industries, Inc.'s Memorandum in Opposition to William Merit & Associates' Motion for Partial Summary Judgment, dated Jul. 2, 2004.
*RTC Ind* v. *William Merit & Assoc.*, United States District Court Northern District of Illinois (Chicago), Case #:1:04- cv-01254.
*RTC Ind.* v. *Fasteners for Retail*, et al., United States District Court Northern District of Illinois (Chicago), Case #:1:03-cv03137.
*RTC Ind.* v. *HMG Worldwide Corp.*, United States District Court Northern District of Illinois (Chicago), Case #:1:00- cv-03300.
*RTC Ind.* v. *Display Specialties*, United States District Court Northern District of Illinois (Chicago), Case #:1:04- cv-03370.
*RTC Ind.* v. *Semasys Inc., et al.* United States District Court Northern District of Illinois (Chicago), Case #:1:04- cv-04081.
*RTC Ind.* v. *Fasteners for Retail, et al.*, United States District Court Northern District of Illinois (Chicago), Case #:1:05- cv-06940.
*VIDPRO International Inc.* v. *RTC Industries, Inc.*, U.S. District Court Northern District of Texas (Dallas), Case #:3:95- cv-01055-G.
*RTC Industries, Inc.* v. *Fasteners for Retail Inc., and CVS Corporation*, Reply, Civil Action No. 03C 3137, dated Sep. 17, 2003.
*RTC Industries, Inc.* v. *Fasteners for Retail, Inc. and CVS Pharmacy, Inc.*, to Vulcan Spring & Mfg. Co., Subpoena in a Civil Case, Case No. 03C 3137 N.D. Illinois, dated Oct. 28, 2003.
*RTC Industries, Inc.* v. *Fasteners for Retail Inc., and CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc., and CVS Pharmacy, Inc.*, to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc., and CVS Pharmacy, Inc.*, to Rexam Cosmetic Packaging, Inc., Subpoena in a Civil Case No. 03C 3137 N.D. Illinois, dated Nov. 11, 2003.
*RTC Industries, Inc.* v. *Fasteners for Retail Inc., and CVS Pharmacy, Inc.*, to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc., and CVS Corporation*, Notice of Motion to Modify and Temporarily Quash Five Subpoenas for Violation of Federal Rule of Civil Procedure 45, Civil Action No. 03C 3137, dated Dec. 18, 2003.
*RTC Industries, Inc.* v. *Fasteners for Retail, Inc. and CVS Pharmacy, Inc.*, Defendants' Opposition to Plaintiffs Motion to Modify and Temporarily Quash Five Subpoenas for Violation of Federal Rule of Civil Procedure 45, Case No. 03C 3137, dated Dec. 10, 2003.
*RTC Industries, Inc.* v. *Fasteners for Retail Inc., and CVS Corporation*, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.
*RTC Ind. Inc.* v. *Fasteners for Retail*, Minute Order of Dec. 12, 2003 by Honorable Joan B. Gottschall, Case No. 1:03- cv-03137.
*RTC Industries, Inc.*, v. *William Merit & Associates, Inc.*, RTC Industries, Inc.'s Response to William Merit & Associates Statement under Local Rule 56.1 of Material Facts to Which There is No Genuine Issue and Statement of Additional Facts that Require the Denial of Summary Judgment, Civil Action No. 04 C 1254, dated Jun. 18, 2004.
*RTC Industries, Inc.*, v. *William Merit & Associates, Inc.*, Index of Exhibits, Civil Action No. 04 C 1254, dated Jun. 18, 2004.

* cited by examiner

PRODUCT MANAGEMENT DISPLAY SYSTEM

CROSS REFERENCE TO RELATED APPLICATION

This Application is a divisional of U.S. application Ser. No. 12/633,417 filed Dec. 8, 2009, which is a continuation of U.S. application Ser. No. 11/409,784, filed Apr. 24, 2006, now U.S. Pat. No. 7,628,282, which is a continuation-in-part and claims benefit to U.S. application Ser. No. 11/257,718 filed Oct. 25, 2005, now U.S. Pat. No. 7,497,342.

FIELD OF THE INVENTION

The present invention relates generally to a shelf assembly for use in merchandising product and more particularly to a shelf assembly having improved mechanisms for displaying and pushing product on the shelves.

BACKGROUND OF THE INVENTION

It is known that retail and wholesale stores, such as drug stores, grocery stores, discount stores, toy stores, and the like, require a large amount of shelving both to store product and to display the product to consumers. In displaying product, it is desirable for the product on the shelves to be situated toward the front of the shelf so that the product is visible and accessible to consumers. To accomplish this placement of product, known systems include the use of a pusher system to push the product toward the front of the shelf as the product at the front of the shelf is removed. Dividing panels or dividers may also be used to separate product on the shelf to provide better organization of the product and to make the display of the product more appealing to consumers. Known merchandising systems that incorporate the use of pusher mechanisms can be found in U.S. Pat. Nos. 6,041,720 and 4,830,201, all of which are assigned to RTC Industries, Inc, and are incorporated herein by reference.

In the past, to display product of varying sizes, the pusher mechanism typically needed to be modified to properly push the product. For example, if the product had a narrow width configuration, often a narrower pusher panel was used to properly push the narrower product on the shelf. Similarly, if the product had a wide width configuration, a wider pusher panel was used to push the product toward the front of the shelf. Alternatively, with wider and/or heavier product, multiple pusher mechanisms and panels were sometimes used to push the product. In some applications, the spring mechanism of the pusher was changed to provide a spring with a greater spring force to properly push the heavier product on the shelf. Such modifications to the merchandising systems were often time consuming and required the use of additional components not readily accessible nearby. Also, the additional components needed to be inventoried by the stores, thereby adding additional cost to the stores. In many instances, the additional components were misplaced or lost by the stores. In addition, the store personnel who often were required to make such modifications to the pusher mechanism, were sometimes incorrectly installing parts and components, which often led to the improper functioning of the merchandising system.

The present invention is directed at overcoming these and other known drawbacks and disadvantages with existing merchandising systems.

SUMMARY OF THE INVENTION

The present invention is directed to a product management display system for merchandising product on a shelf. The invention includes using a pusher mechanism along with one or more roller assemblies that, in combination, improve the merchandising of product on the shelves, especially on horizontal or non-inclined shelves or surfaces.

In accordance with an illustrative embodiment of the invention, the product management display system includes a pusher mechanism mounted to a track that extends generally from the front of the shelf to the back of the shelf. The pusher mechanism is configured to urge product forward and toward the front of the shelf. At least one roller assembly is positioned beneath the product to be merchandised to assist the pusher mechanism in urging the product toward the front of the shelf. Significantly, the invention may be mounted to a horizontal shelf or surface and heavier and/or wider product may be properly merchandised without the need to modify the system, as was previously required.

Additional features and advantages of the invention will be apparent upon reviewing the following detailed description.

Figure 1:
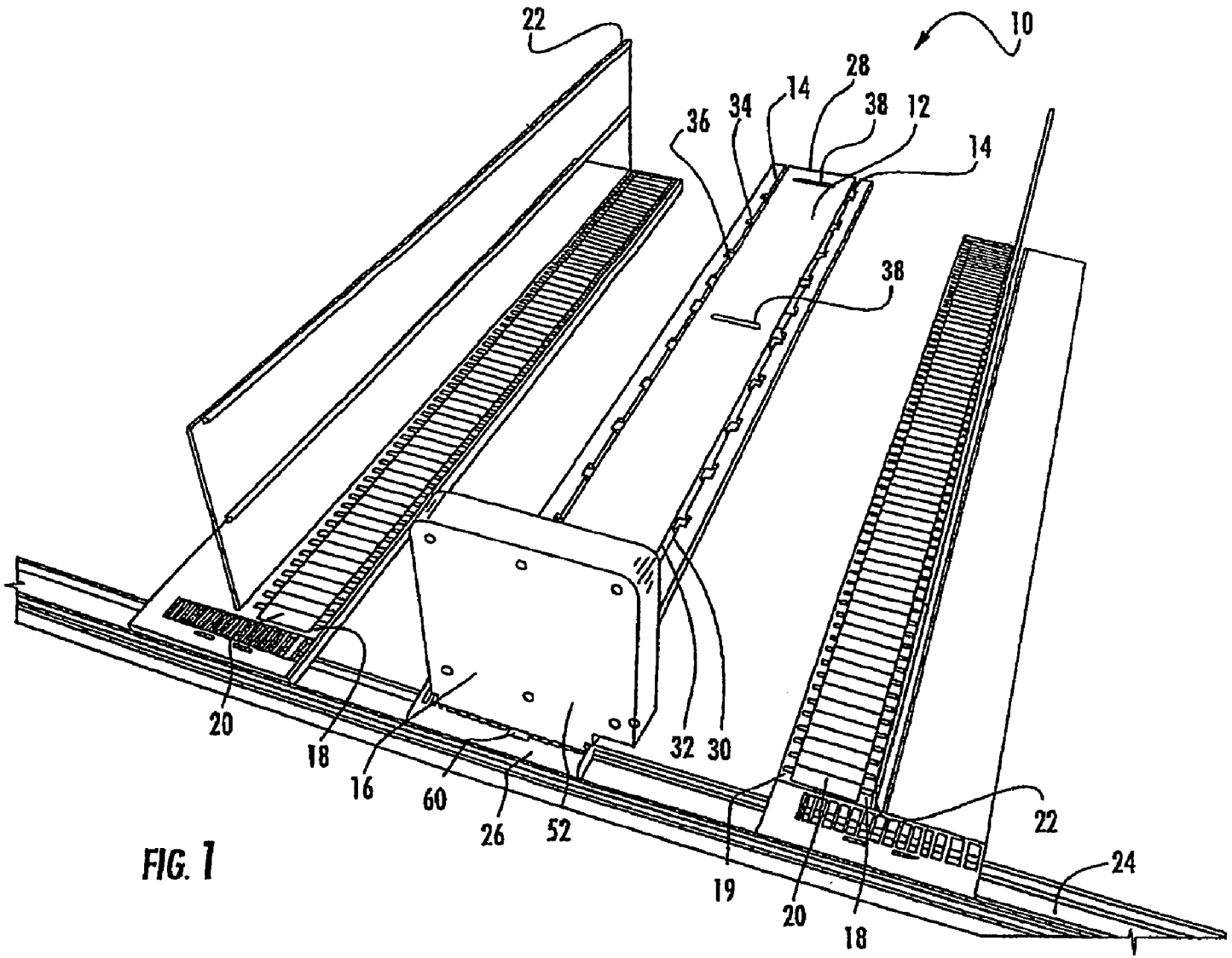
FIG. 1 depicts an isometric front view of an exemplary embodiment of a product management display system of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION OF THE INVENTION

The invention may be embodied in various forms. Referring to the Figures wherein like numerals indicate like elements, there is depicted in FIG. 1 an isometric front view of an exemplary embodiment of the present invention. Exemplary merchandise system 10 includes a base 12 defining one or more tracks 14 on which is mounted a pusher mechanism 16 that may slide along the tracks. The system 10 further includes at least one roller assembly 18 that includes a plurality of rollers 20 configured in an aligned manner on the assembly 18. A divider 22 may also be used to separate product into rows. The base 12, pusher mechanism 16, roller assembly 18 and divider 22 may also be mounted to a front or rear rail 24. The components of the system 10 may be separate components, components joined together, or components configured together as a unitary, one-piece assembly.

The exemplary merchandise system 10 allows for the placement and pushing of larger and/or heavier product on a shelf or surface and in particular on a horizontal or non-inclined shelf or surface. The invention also permits the pushing of products having product packaging that does not readily slide on a horizontal shelf or surface. For instance, cases of soft drinks or boxes of detergent that are packaged in a cardboard or paper-based material are often not readily slidable on the shelf without significant effort due to the weight of the product and the friction forces between the product packaging and the shelf on which the product is placed. The merchandise system 10 improves the merchandising of these and other products through the use of the exemplary pusher mechanism 16 used with the one or more exemplary roller assemblies 18. By placing the product on one or more of the roller assemblies 18, the pusher mechanism 16 will be able to more readily urge the product toward the front of the shelf or toward the aisle for proper merchandising of the product.

Advantageously, with the exemplary pusher mechanism 16 and roller assembly 18, heavier product that was previously placed on a horizontal shelf or surface, or product that did not readily slide on the shelf or surface, may now be properly merchandised without the need to make changes to the system. In addition, with the invention being selectively positionable at any position along a shelf or other surface, the merchandise system can accommodate and properly push nearly any product normally merchandised on the shelf regardless of its size, shape, weight, configuration, and type of packaging.

Referring to FIG. 1, in an exemplary embodiment, the base 12 defines a generally flat planar surface that may be configured to engage with or mount onto any known shelf used in a store, and in any known mounting configuration and orientation. The base 12 defines a front edge 26, a back edge 28, and one or more tracks 14 extending along the base 12 from the front edge 26 to the back edge 28. As illustrated, two tracks 14 can be used with each pusher mechanism 16 and are spaced apart to mount the pusher mechanism 16. It should be understood that more or less than two tracks could be used with the invention, depending on the particular application. The front edge 26 of the base 12 is configured to mount to or on the rail 24 in any known manner. Once mounted, the base 12 may be slidable along the rail 24 to any position along the rail 24 to thereby locate the mounted pusher mechanism 16 in any desired position behind the product.

The tracks 14 extend longitudinally along the length of the base 12 and each track defines at least one rail 30 and an elongated aperture or channel 32 in the base 12. The aperture 32 and rail 30 are sized and shaped to receive and mount a mating flange of the pusher mechanism 16, as described below. When viewed from either the front edge 26 or the back edge 28 of the base 12, the exemplary rail 30 and aperture 32 can generally define an "L" shaped configuration. This configuration permits the flange of the pusher mechanism 16 to slidably mount to the base 12 and yet prevents the pusher mechanism 16 from lifting out of the track 14. The present invention contemplates the use of other shapes of rails and apertures to mount the pusher mechanism 16 to the base 12.

Extending between the rails 30 may be one or more support ribs 34 that serve to support the rails and ensure the proper spacing between the rails. In addition, one or more of the mounting rails 30 may define one or more cut-out portions 36 that may be located along the rails including at the location of the support ribs 34.

As depicted in FIG. 1, positioned on the base 12 at various positions along the base 12 are transversely extending slots 38 that serve to releasably hold the pusher mechanism 16 in a stationary position at that location during the restocking of the product on the shelf. The slots 38 may be positioned at any location along the base 12 and may define any numerous configurations to receive and hold the pusher mechanism 16 in position.

The roller assembly 18 includes a roller housing 19 containing numerous rollers 20 that are mounted to the housing 19. The roller housing 19 is generally depicted as an elongated body that may be positioned at any position on the shelf, such as alongside the pusher mechanism 16, alongside a product divider 22, or in space between the pusher mechanism and product divider. In essence, the invention contemplates the placement of the roller assembly 18 at any desired position on the shelf where the roller assembly can provide assistance in the merchandising of product toward the front of a shelf or toward the aisle.

As shown in FIG. 1, the roller assembly 18 may be connected to or formed integral with the product divider 22 or a product divider base from which extends the product divider. In an exemplary embodiment, the roller assembly 18 may be positioned on one or both sides of the product divider 22. While the illustrated embodiment depicts one roller assembly 18 positioned on one side of the divider, it is contemplated that the roller assembly 18 may be positioned on both sides of the divider to assist in merchandising multiple rows of product. In yet another embodiment, the roller assembly 18 may stand-alone from or be positioned away from the product divider 22. As will be readily appreciated, the position or location of the roller assembly 18 may vary depending on the size and shape of the product to be placed on the roller assembly 18 for merchandising.

The roller assembly 18 may be mounted to the rail 24 using any known mounting technique or may be mounted directly to the shelf. Alternatively, the roller assembly 18 may be mounted to a back rail, not shown, but known in the art. Depending on the type of rail used, the roller assembly 18 may be snap-fit into or onto the rail or may be slid into or onto the rail. The roller assembly 18 may further be configured to be movable to any one of the numerous positions along the rail, regardless of whether a front rail, rear rail or both are used. In another alternative embodiment, the housing 19 of the roller assembly 18 may be mounted to other structure that is mounted to a shelf or rail, or the housing 19 may simply sit on the shelf or other surface. As should be readily appreciated, there are numerous ways of mounting the roller assembly 18 all of which are contemplated by the invention.

Figure 3:
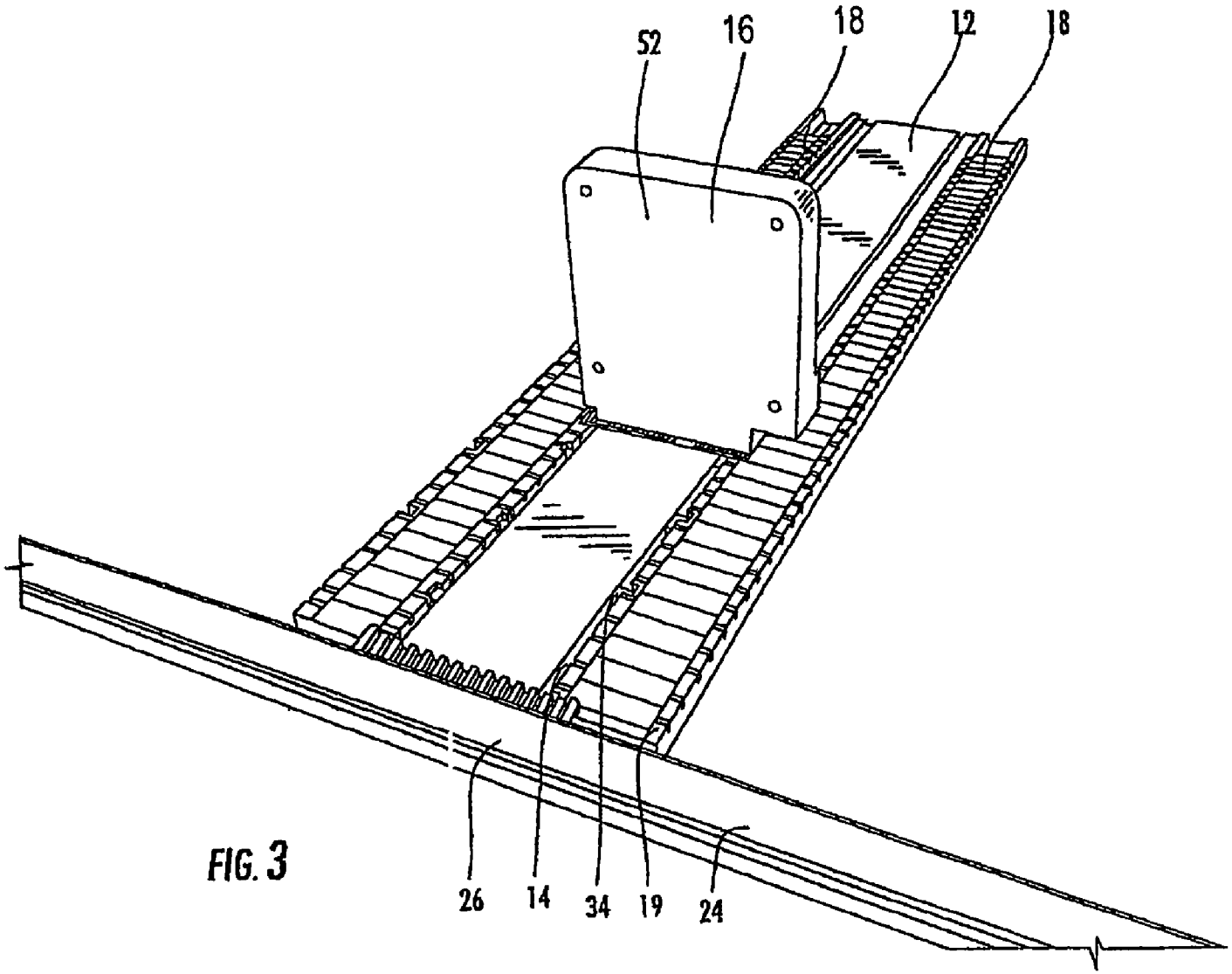
FIG. 3 depicts an isometric front view of another exemplary embodiment of a product management display system of the present invention.

Referring to FIG. 3, in an alternative embodiment, the housing 19 of the roller assembly 18 may be connected to or formed integral with the pusher mechanism 16. In one exemplary embodiment, one roller assembly 18 may be positioned on each side of the pusher mechanism 16. Alternatively, the roller assembly 18 may stand-alone from or be positioned away from the pusher mechanism 16, again depending on the type of product to be merchandised.

Referring back to FIG. 1, the rollers 20 are mounted to the housing 19 in generally an aligned manner and are spaced apart to provide the proper directional movement of the product placed on the rollers 20. The number and spacing of the rollers 20 may vary depending on the application. The invention is therefore not limited to the number, placement, spacing, orientation or configuration of the rollers 20 as numerous alternative embodiments are possible.

Figure 5:
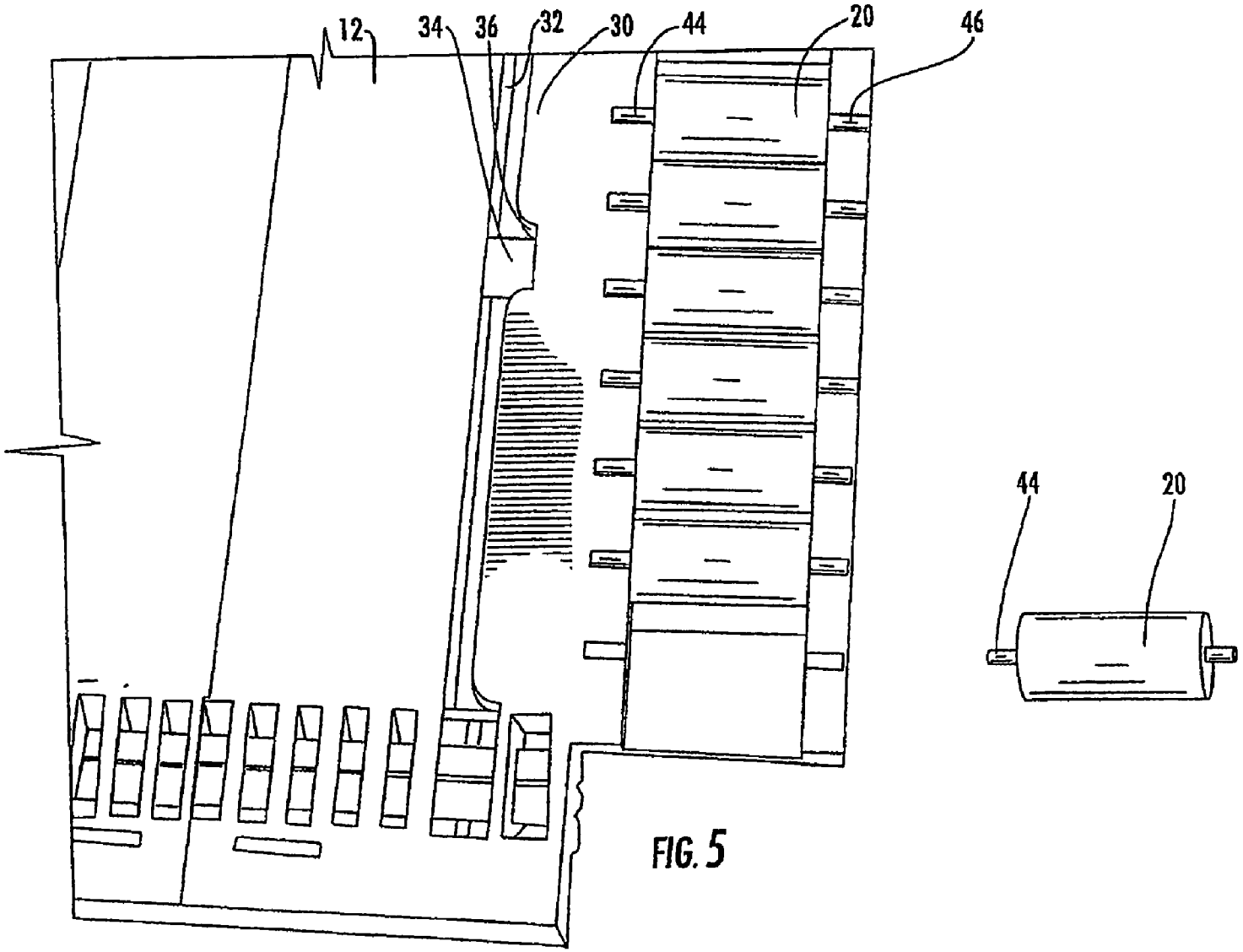
FIG. 5 depicts a partial view of an exemplary roller assembly and exemplary roller used with the present invention.

Referring to FIG. 5, there is depicted an exemplary roller 20 of the invention. The roller 20 may be made of a plastic material and may define a generally cylindrical shaped structure. The roller 20 may also include opposing, outwardly extending pins 44 that are centrally located at each end of the roller 20. The pins 44 will mount in spaced apart slots or grooves 46 formed in the roller housing 19. The slots or grooves 46 are configured to permit rotational movement of the rollers once mounted.

Figure 2:
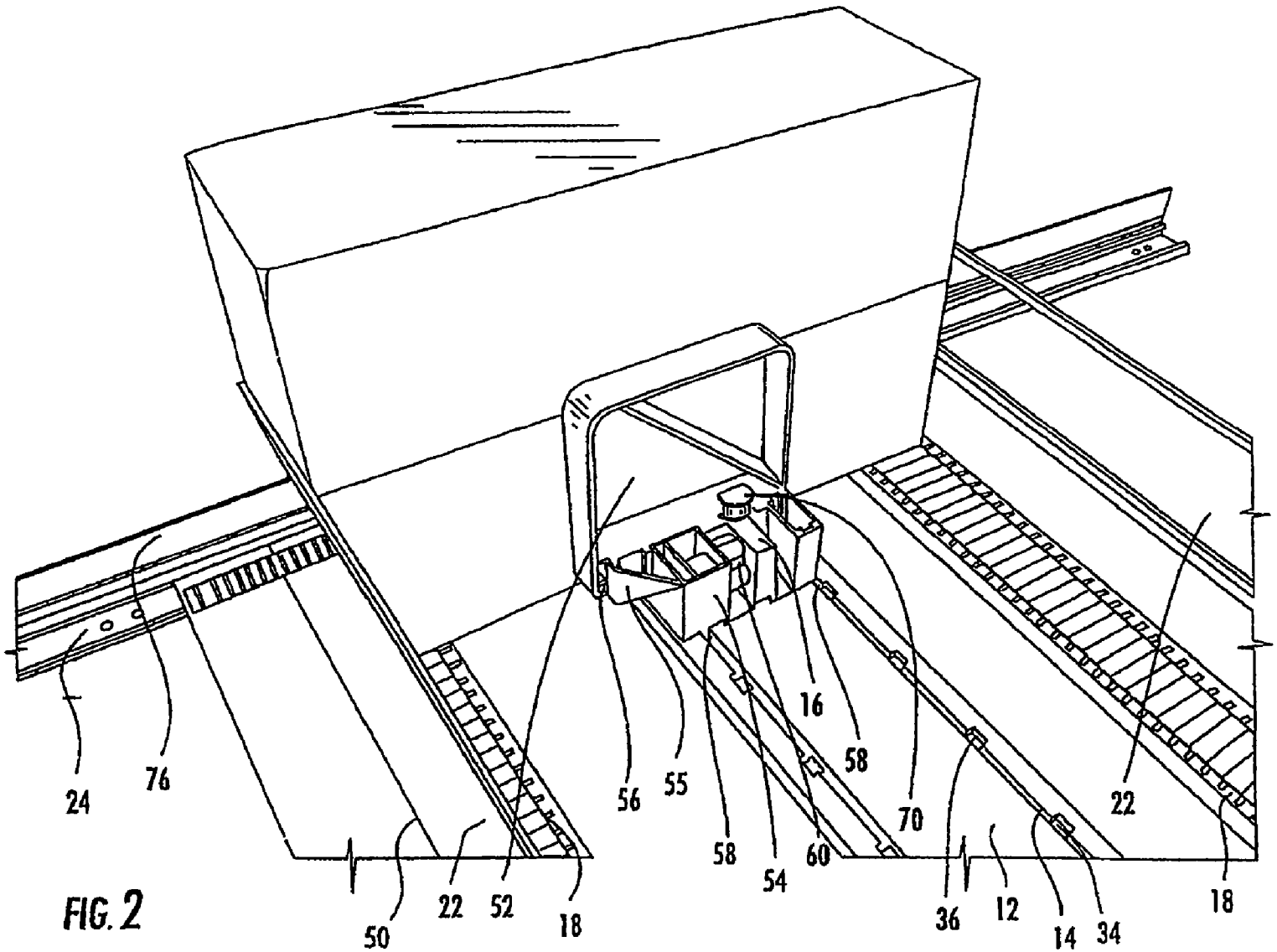
FIG. 2 depicts an isometric rear view of the product management display system of FIG. 1.

Referring to FIG. 2, the merchandise system 10 is shown pushing product. As depicted, in an exemplary embodiment, the product divider 22 is used to separate merchandised product into rows on the shelves. In one embodiment, the divider 22 is formed integral with a divider base 50 as a unitary, one-piece structure. In this embodiment, the divider 22 may be formed with the base 50 such that it cannot slide out of or be lifted from the base 50. In another embodiment, the divider 22 may be slidably positioned in a slot that is formed in the base 50 and that extends from the front to the back of the base 50. With this configuration, the divider 22 may be a removable divider that is slidably removed or lifted from the slot formed in the base 12. As can be appreciated, the divider 22 may define various configurations. As an example, depending on the size and shape of the merchandised product, the divider 22 may define a height and length suitable to separate the rows of product to be merchandised. Indeed, the divider 22 may define any shape, profile, or contour that enhances the placement and removal of product on the shelf.

As shown in FIG. 2, the product to be merchandised seats on two spaced apart roller assemblies 18 as well as the base 12 of the pusher mechanism. The depicted roller assemblies 18 are positioned at opposing ends of the product to support the product at the ends. In operation, the pusher mechanism 16 will urge or push the product toward the rail 24 and the roller assemblies 18 will assist the pusher mechanism is pushing the product. As should be appreciated, the roller assemblies 18 may be positioned at any desired location beneath the product.

Referring back to FIG. 1, in an exemplary embodiment, the pusher mechanism 16 may define a flat, planar pusher surface or panel 52 or another shape suitable to pushing specific product packages. The pusher surface 52 further defines a thickness suitable for pushing wider, heavier product without experiencing undue bending of the pusher mechanism. The pusher surface 52 may be made of any known material, such as a plastic material, that is suitable for pushing product.

As illustrated in FIG. 2, the pusher surface 52 is coupled to the track 14 through the use of a pusher support base 54. The pusher surface 52 may be fixedly mounted to the support base 54 or may be slidably mounted to the support base 54 along a support track 56. If a support track 56 is used, the pusher surface 52 may be slidably adjustable in a generally horizontal manner to adjust the location of pusher surface 52 behind the product. One skilled in the art will appreciate that other techniques for mounting the pusher surface 52 to the pusher support base 54 are possible and that the support track 56 is simply illustrative of an exemplary embodiment. For example, it is contemplated that the pusher surface may be operatively mounted to the base 12 without the use of tracks. That is, the system may be a trackless system in that the pusher surface may simply sit on the base 12 without the use of flanges, tracks or any other structure that could be used to hold the pusher surface to the base.

The support base 54 defines outwardly extending flanges 58 used to slidably mount and secure the support base 54 to one or more tracks 14 and more specifically to the one or more rails 30 of the tracks 14. The flanges 58 serve to hold the support base in the tracks. The flanges 58 serve to hold the support base in the tracks. The support base 54 defines a sufficient width and depth to provide the pusher surface 52 with a support foundation that will allow the pusher surface 52 to properly push larger and often heavier product on the shelf without the undesirable binding of the flanges 58 in the tracks 14. Also, in an exemplary embodiment, the outwardly extending flanges 58 are spaced apart on the support base 54 to provide a support foundation that will prevent bending or tipping of the pusher surface 52 as it pushes the larger and often heavier product. One of skill in the art will appreciate that the number, positioning, spacing and configuration of the flanges 52 will vary depending on the desired application and the size of the product being pushed and that the invention is therefore not so limited.

In an exemplary embodiment, the support base 54 also defines a base extension 55 that serves as a support structure for the mounted pusher surface 52. The base extension 55 is depicted as protruding outwardly from the support base 54 and across the back side of the pusher surface 52. The base extension 55 may be formed integral with the support base 54 or may be attached to the support base 54 using known attaching techniques.

The support base 54 also serves to contain at least one pusher urging element 60 used to urge the pusher surface 52 toward the front of the shelf. The pusher urging element 60 may be any biasing element including, without limitation, a flat coil spring commonly used with pusher systems. The present invention may use one or more pusher urging elements 60 to urge the pusher surface 52 depending on the desired application. The coil tension of the pusher urging element 60 may also vary depending on the particular application.

The pusher urging element 60 may be mounted to the pusher mechanism 16 and the base 12 using any known mounting technique. In the exemplary embodiment, one end of the pusher urging element 60 is secured to the base 12 near the front edge 26 of the base 12, and the opposing end of the pusher urging element 60, which is depicted as a coiled end, is positioned behind the pusher mechanism 16 to urge the pusher mechanism 16 toward the front of the shelf, as known in the art. Other mounting configurations of the pusher urging element 60 are possible with the present invention. In other words, the fixed end of the pusher urging element 60 may be mounted to the pusher mechanism 16, while the other coiled end may be operatively mounted to the base 12 or other structure.

Located behind the pusher surface 52 and on top of the support base 54 is a plunger 70. The plunger 70 is configured to extend through the support base 54 to engage the transversely extending slot 38 to releasably hold the pusher mechanism 16 at the location of the slot on the base 12. In an exemplary embodiment, when the pusher mechanism is positioned over one of the slots 38, the plunger may be manually actuated downward and into the slot. Once in the slot, the pusher mechanism 16 will be held in position to permit the restocking of product in front of the pusher mechanism. To disengage the plunger from the slot, a user need only push rearward on the pusher surface 52 away from the front of the shelf and the plunger will automatically retract from the slot permitting the free movement of the pusher mechanism on the base.

In an alternative embodiment, it is contemplated that the pusher mechanism 16 may be mounted to the divider 22 in the same manner and using the same techniques described above with respect to the mounting of the pusher mechanism 16 to the base 12, or in any known mounting technique, such as the technique described in U.S. Pat. No. 4,830,201, incorporated by reference. In this configuration, the pusher mechanism 16 will slidably move along the length of the divider 22. Other pusher mounting techniques are possible with the invention.

Figure 4:
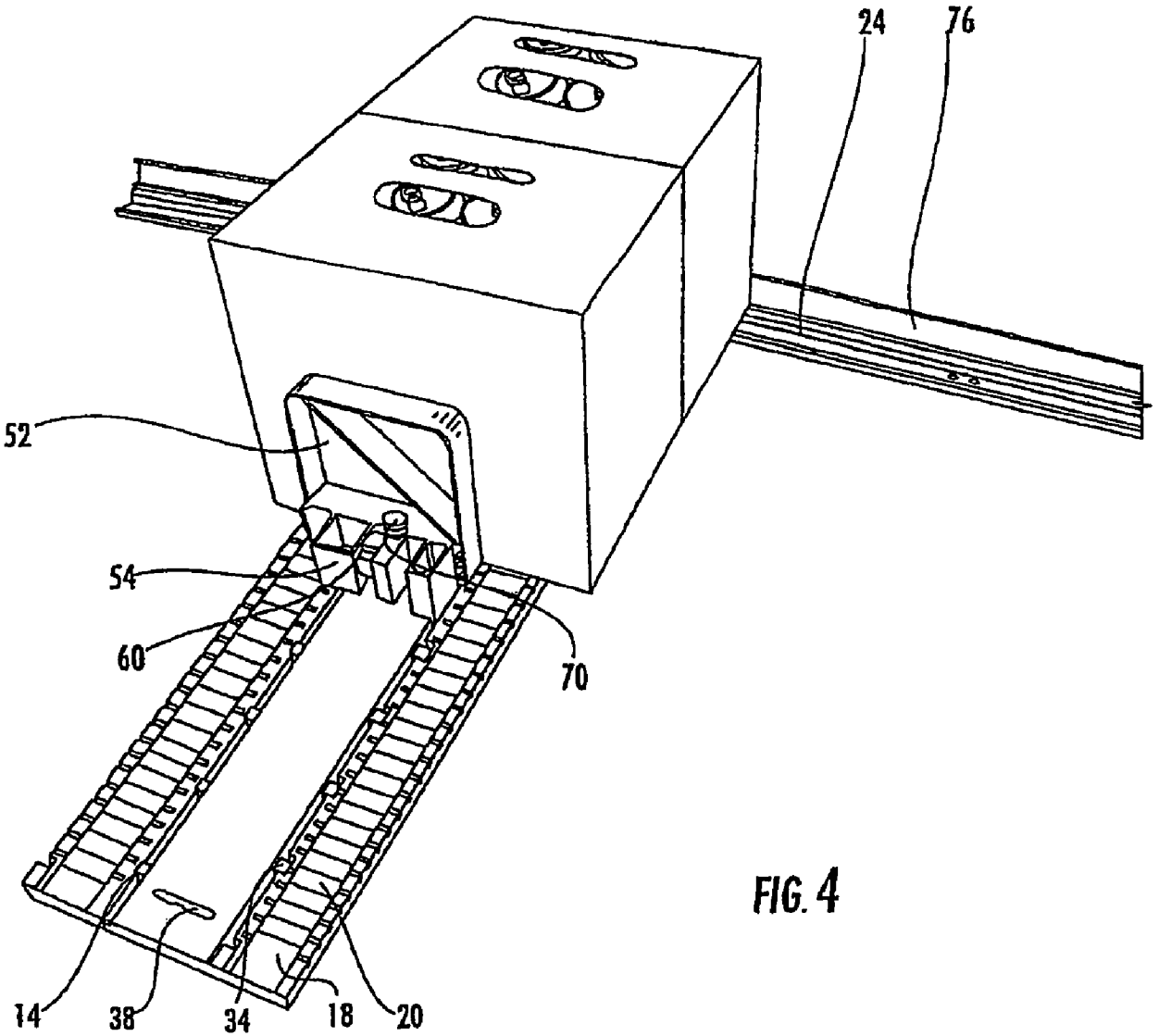
FIG. 4 depicts an isometric rear view of the product management display system of FIG. 3.

Referring to FIG. 3, an alternative embodiment of the merchandise system 10 includes the use of the base 12 and pusher mechanism 16 with roller assemblies 18 positioned on both sides of the base 12. The roller assemblies 18 may be attached to or formed integral with the base 12, or may be spaced apart from the base. The base 12 may be mounted to a rail 24 and the rail 24 may include a front retaining wall 76 to retain product that is pushed toward the rail. Additionally, a divider may be attached to or formed integral with the base 12, which may be attached to or formed integral with the roller assemblies 18. As shown in FIG. 4, the pusher mechanism 16 will urge the product toward the rail 24 and the roller assemblies 18 will assist the pusher mechanism 16 in pushing the product toward the rail. With this embodiment, one of skill in the art will appreciate that the roller assemblies may be positioned at numerous locations below the product and still aid the pusher mechanism is pushing the product. In addition, one skilled in the art will understand that one roller assembly may be sufficient to assist the pusher mechanism, depending on the product to be merchandised. With the embodiment of FIGS. 3 and 4, the base 12 and pusher mechanism 16 may be the same as the base and pusher mechanism described above with respect to FIGS. 1 and 2.

Referring to FIGS. 6-9, alternative embodiments of the merchandise system are shown. In one embodiment depicted in FIGS. 6 and 7, the merchandise system includes the use of a base 82 and pusher mechanism 86 with roller assemblies 88 positioned on both sides of the pusher mechanism 86. The roller assemblies 88 may be attached to or formed integral with the base 82, or may be detachable from the base. A product divider 89 may be positioned on the base 82 along the roller assemblies. The divider 89 may be removable or permanently affixed to the base 82. Alternatively, the divider 89 may be a component separate and spaced apart from the base 82.

Figure 6:
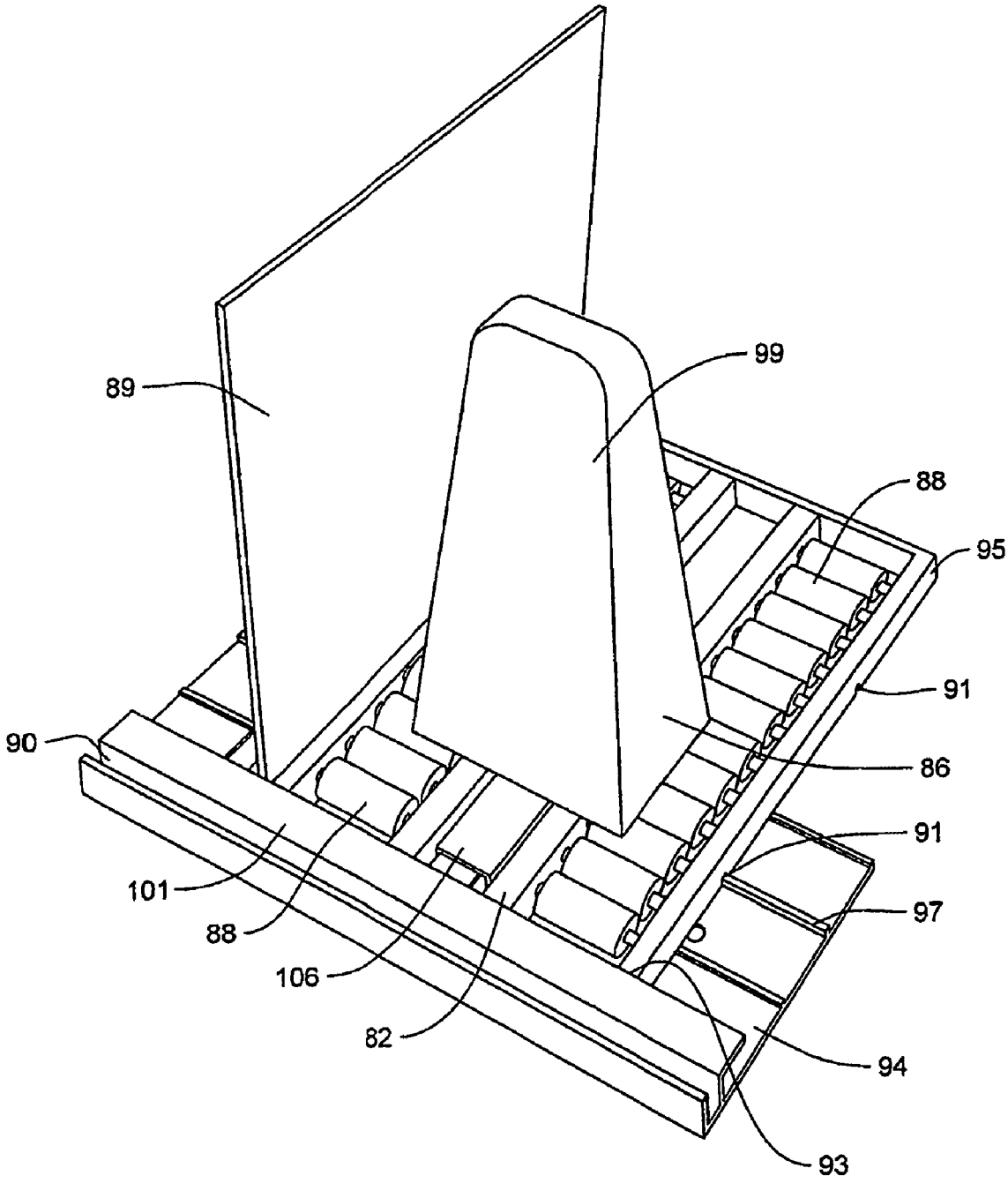
FIG. 6 depicts an isometric view of another exemplary embodiment of a product management display system of the present invention.

The base 82 may be mounted to a rail 94 in any known manner and may be slidable or stationary relative to the rail. It should be understood that the system may be used without the rail 94. The base 82 may be symmetrical in that it may include rail mounting features 91 in the both ends 93, 95 of the base 82. The rail mounting features may include grooves or channels that may engage with the rail 94 and mating ribs or mounting members 97. With this configuration, either end of the base 82 may be mounted to the rail 94, thus creating a left side merchandise system, as shown in FIG. 6, or a right side merchandise system, if the end 95 of the base is mounted to the rail 94. This configuration enhances the functionality of the base. The rail 94 may further include channels or grooves 90 that may receive a front retaining wall, not shown, to retain product that is pushed toward the rail 94. The rail 94 may further include a flange or mounting surface 101 for positioning and mounting the base 82 to the rail 94 and for holding the base to the rail and preventing the base from lifting up from the rail. The base 82 and rail 94 may include other possible mounting configurations, such as a tongue and groove configuration, to permit the mounting of the base to the rail.

Figure 7:
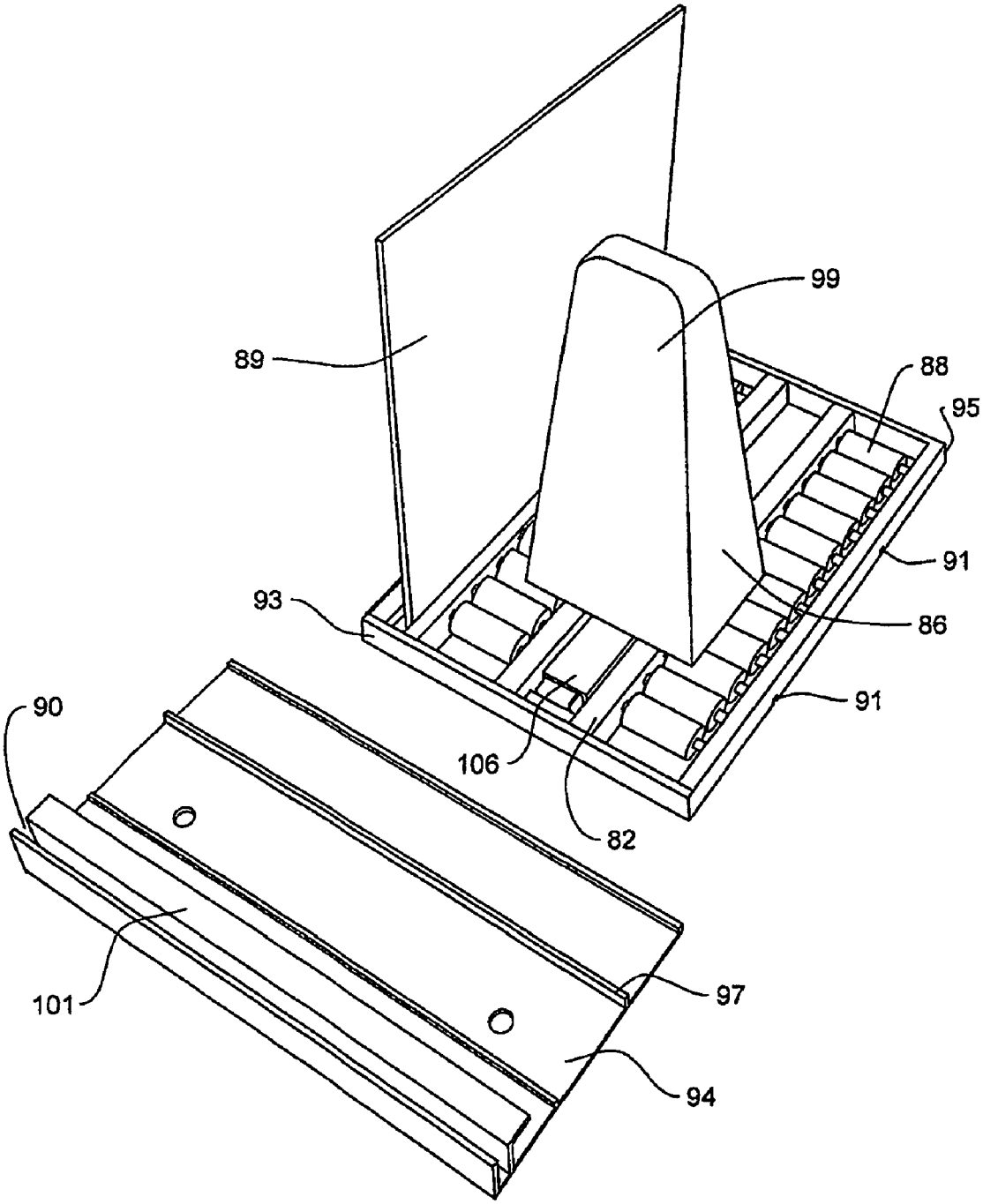
FIG. 7 depicts another isometric view of the product management display system of FIG. 6.

Referring to FIGS. 6 and 7, the pusher mechanism 86 may include a pusher paddle or surface 99 that may be mounted to a track formed on the base 82 (FIGS. 6 and 7) using any known track mounting configuration, such as a flange and rail configuration, a tongue and groove configuration, or any other configuration that permits the slidable movement of the pusher mechanism relative to the base. Alternatively, the pusher mechanism may be a trackless configuration (FIGS. 8 and 9) where the pusher mechanism is positioned on the top surface of the base 82 and slides along the top surface of the base.

Figure 8:
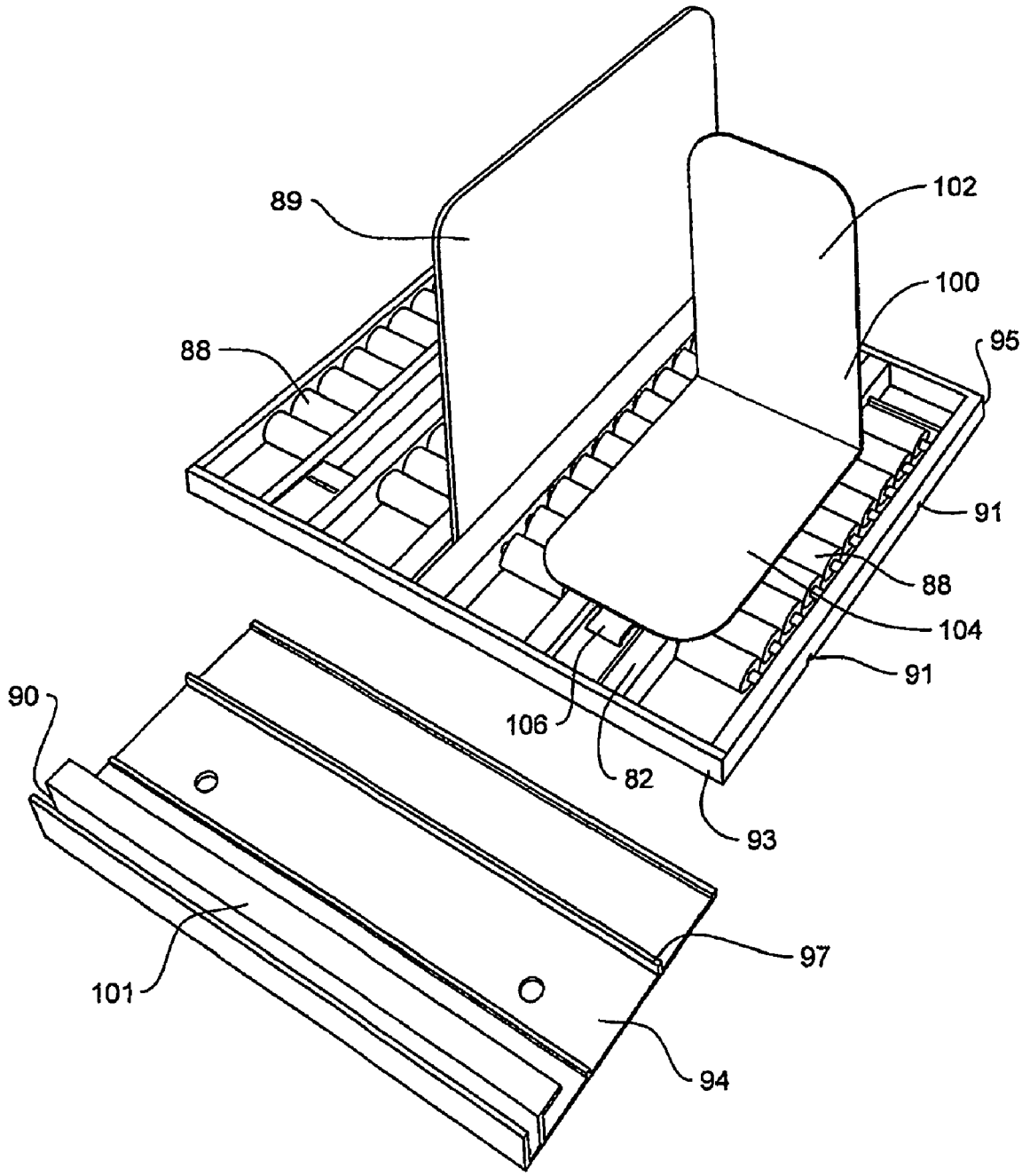
FIG. 8 depicts an isometric view of yet another exemplary embodiment of a product management display system of the present invention.
Figure 9:
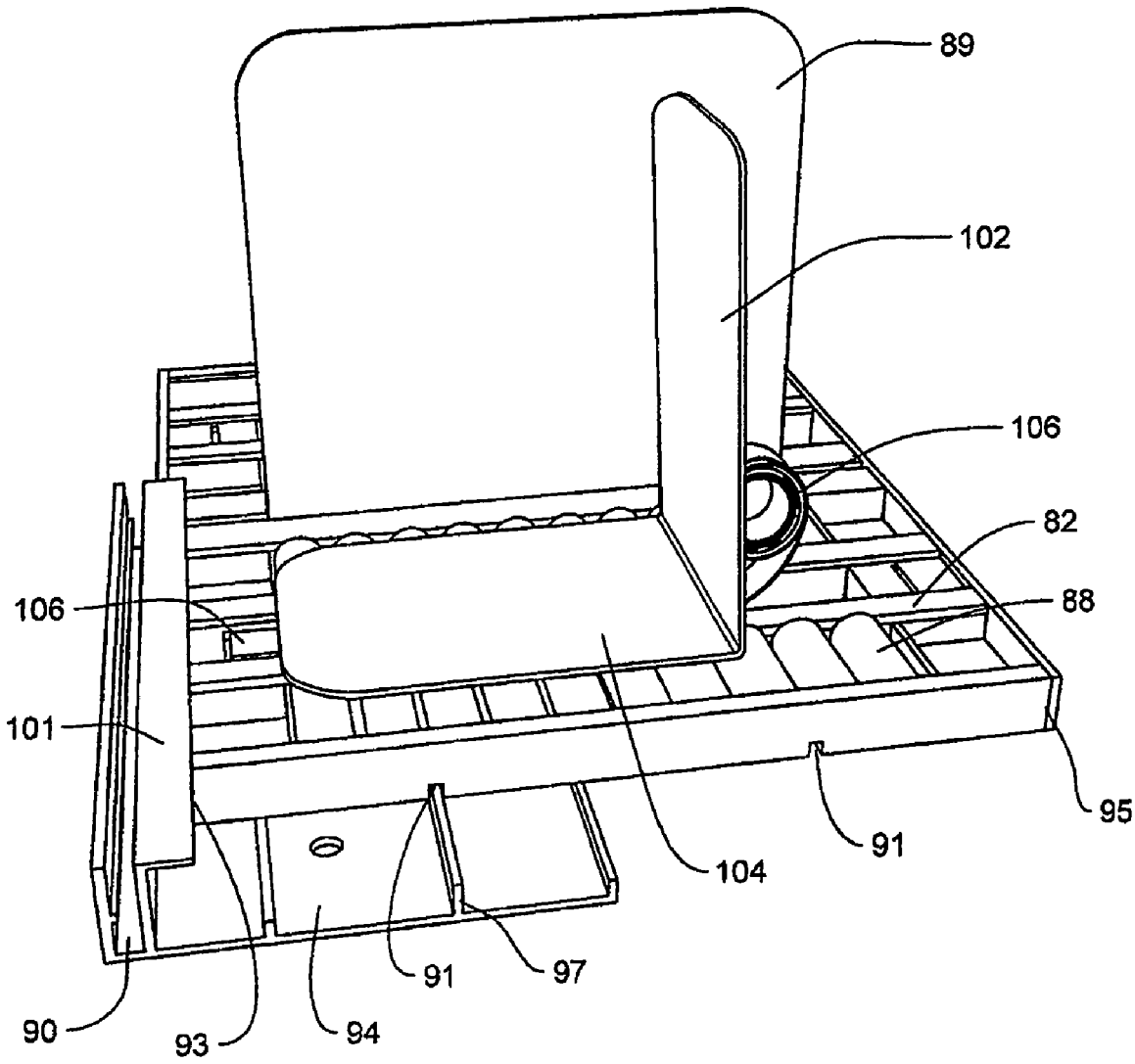
FIG. 9 depicts a side view of the product management display system of FIG. 8.

As shown in FIGS. 8 and 9, the pusher mechanism 100 includes a pusher paddle or surface 102 that may further include a floor 104 that extends forward of the pusher paddle or surface in a substantially perpendicular manner. The bottom surface of the floor 104 sits on the base and slides along the base 82, and more particularly along the roller assemblies 88 mounted to the base 82. With this embodiment, product to be merchandised may be positioned on this floor. The product may assist in holding the pusher mechanism onto the base during operation of the system. The pusher paddle and floor may define any suitable shape and configuration that permits the merchandising of product. As depicted in FIGS. 8 and 9, the roller assemblies 88 may be positioned on both sides of the product divider 89.

With the embodiments shown in FIGS. 6-9, a coiled spring 106 may be used and may extend across the top surface of the base 82 to urge the pusher mechanism toward the rail. Product to be merchandised may also be placed on the coiled spring to assist in holding the pusher mechanism down onto the base 82.

As shown in FIGS. 6-9, the pusher mechanism may extend over and sit on the rollers of the roller assemblies 88. With this configuration, the pusher mechanism will roll along the roller assemblies, thereby improving the slidability of the pusher mechanism relative to the base 82. With this configuration, the pusher mechanism will slide in a relatively frictionless manner along the base. Alternatively, the pusher mechanism may be configured so that it does not extend over and sit on the rollers, depending on the desired application.

In an exemplary embodiment, the roller assemblies 88 may be spaced sufficiently apart relative to each other and relative to the product divider 89 such that the weight of the product to be merchandised, such as cases of soda, can be properly positioned on the rollers. For example, if the product to be merchandised is a case of soda in cans, a roller assembly 88 can be positioned below each row of soda cans in the case. In this manner, the weight of the cans may be properly positioned over the rollers, thereby improving the ease at which the case of soda will roll along the rollers, reducing the stress on the packaging containing the cans, and preventing any undesirable damage to the packaging. One of skill in the art will appreciate that the roller assemblies may be positioned at numerous locations below the product to be merchandised, depending on the weight and configuration of the product, to properly support the weight of the product and further assist the pusher mechanism in urging the product forward or toward the rail, if a rail is used.

Variations and modifications of the foregoing are within the scope of the present invention. For example, one of skill in the art will understand that multiples of the described components may be used in stores and in various configurations. The present invention is therefore not to be limited to the single system 10, nor the upright pusher configuration, depicted in the Figures, as the system 10 is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A product management display system, comprising:

a trackless pusher mechanism mountable to a base, the trackless pusher mechanism movable along a top surface of the base, at least two roller assemblies mountable to the base, the at least two roller assemblies each including a plurality of rollers extending along a length of the base, wherein at least one of the at least two roller assemblies is positioned on each side of the trackless pusher mechanism, and a divider mountable to the base for dividing displayed merchandise into rows.

2. The product management display system of claim 1, wherein the divider extends along the length of the base.

3. A product management display system, comprising:

a trackless pusher mechanism mountable to a base, the trackless pusher mechanism movable along a top surface of the base, at least two roller assemblies mountable to the base, each of the at least two roller assemblies including a plurality of rollers extending along a length of the base, and a divider mountable to the base for dividing displayed merchandise into rows, and wherein at least one of the at least two roller assemblies is positioned on each side of the divider.

4. The product management display system of claim 3, wherein the divider extends along the length of the base.

* * * * *